US011224293B2

(12) United States Patent
Case

(10) Patent No.: US 11,224,293 B2
(45) Date of Patent: Jan. 18, 2022

(54) GAMING CHAIRS WITH ENHANCED VISIBILITY LIGHTING

(71) Applicant: Ace Casual Limited, Bradford (GB)

(72) Inventor: Gareth Case, Bradford (GB)

(73) Assignee: Ace Bayou Corp., Kenner, LA (US)

( * ) Notice: Subject to any disclaimer, the term of this patent is extended or adjusted under 35 U.S.C. 154(b) by 0 days.

(21) Appl. No.: 17/070,487

(22) Filed: Oct. 14, 2020

(65) Prior Publication Data

US 2021/0030159 A1 Feb. 4, 2021

Related U.S. Application Data

(60) Provisional application No. 62/991,441, filed on Mar. 18, 2020.

(51) Int. Cl.
*A47C 7/72* (2006.01)
*A47C 1/02* (2006.01)

(52) U.S. Cl.
CPC ..... *A47C 7/725* (2013.01); *A47C 1/02* (2013.01)

(58) Field of Classification Search
CPC ..... A47C 7/725; F21W 2131/301; A47B 2220/0077; A47G 1/0622
See application file for complete search history.

(56) References Cited

U.S. PATENT DOCUMENTS 3,790,431 A 2/1974 Tung
3,934,065 A 1/1976 Tung
5,207,852 A 5/1993 Lightle
5,918,932 A * 7/1999 Morrison ..... A47B 97/00 108/23
6,355,302 B1 3/2002 Vandenberg
7,374,315 B2 * 5/2008 Dorsey ..... F21V 23/04 362/294
7,559,667 B2 * 7/2009 Holderman ..... A47C 7/725 297/217.6
8,215,810 B2 * 7/2012 Welch, Sr. ..... B60R 13/02 362/488
10,259,386 B2 * 4/2019 Unger ..... B60Q 3/64
(Continued)

FOREIGN PATENT DOCUMENTS

CN 106859115 A 6/2017
CN 107692601 A 2/2018
(Continued)

OTHER PUBLICATIONS

International Search Report and Written Opinion received for PCT/IB2020/000902, dated Feb. 5, 2021, 13 pgs.
(Continued)

*Primary Examiner* — Sarah B McPartlin
(74) *Attorney, Agent, or Firm* — Micheal Bondi; Moss & Barnett

(57) ABSTRACT

A lighted gaming chair including a chair and enhanced visibility lighting. The chair has a seat portion and a back portion mounted with respect to the seat portion. The enhanced visibility lighting is attached to the chair. The enhanced visibility lighting includes a light source and a diffusion layer that substantially covers the light source. The light source has a first width. The diffusion layer has a second width that is more than two times the first width. Light emitted from the light source passes through the diffusion layer.

21 Claims, 13 Drawing Sheets

(56) References Cited

U.S. PATENT DOCUMENTS

| | | | | |
|---|---|---|---|---|
| 10,624,460 | B2 * | 4/2020 | Ma | H05B 45/20 |
| 2007/0257530 | A1 | 11/2007 | Florez | |
| 2015/0197186 | A1 * | 7/2015 | Salter | B60Q 3/80 362/510 |
| 2015/0274068 | A1 * | 10/2015 | Falconi | B60N 2/60 297/217.6 |
| 2016/0229338 | A1 * | 8/2016 | Sato | B60R 13/02 |
| 2017/0245648 | A1 | 8/2017 | Charlebois | |
| 2019/0293278 | A1 * | 9/2019 | McNae | A47C 31/008 |

FOREIGN PATENT DOCUMENTS

| | | | |
|---|---|---|---|
| CN | 108652308 | A | 10/2018 |
| CN | 110477652 | A | 8/2019 |
| CN | 110432680 | A | 11/2019 |
| CN | 209595196 | U | 11/2019 |
| FR | 2892494 | A1 | 4/2007 |

OTHER PUBLICATIONS

Genesis: "Genesis Trit 500 RGB and trit 600 RGB—Chairs made for gamers", YouTube, Feb. 20, 2020. URL: https://www.youtube.com/watch?v=kbTe7HGX0K4. 1 pg.

Combined Search and Examination Report for UK Application No. GB2016821.7, Dec. 8, 2020, 8 pgs.

Cherry Tree Furniture, Mar. 11, 2020, Cherry Tree Furniture VIRIBUS X1 Office Gaming Chair with 12-Colour LED Light (Grey & Black), Amazon UK, [online], URL: https://www.amazon.co.uk/cherry-tree-furniture-VIRIBUS-12-colour/dp/B085RKLGFM/ref=asc_df_B085RKLGFM/?tag=&linkCode=df0&hvadid=4279, 7 pgs.

Intey, Dec. 16, 2019, Intey Lighting Gaming Chair Ergonomic Racing Chair 160 Reclining Swivel Heavy Duty High Back Office PC Desk Chair with Headrest and Lumbar Cushion, RGB LED, 5V 2A, Tilt & Lock Function, Amazon UK. URL: https://www.amazon.co.uk/INTEY-Lighting-Ergonomic-Reclining-Headrest/dp/B082SYKH5W/ref=sr_1_6?dchild=1&keywords=gaming+chair+and+lights&qid=1607090009&sr=8-6, 9 pgs.

* cited by examiner

GAMING CHAIRS WITH ENHANCED VISIBILITY LIGHTING

REFERENCE TO RELATED APPLICATION

This application claims priority to U.S. Applic. No. 62/991,441, which was filed on Mar. 18, 2020. The contents of which are incorporated herein by reference.

FIELD OF THE INVENTION

The invention relates generally to gaming furniture. More particularly, the invention relates to gaming chairs with enhanced visibility lighting.

BACKGROUND OF THE INVENTION

Video games are a popular form of entertainment. To enhance the experience associated with video games and/or to enhance the performance while playing video games, chairs have been marketed to include sound and/or vibrations. A variety of multimedia furniture is marketed by Ace Bayou Corporation, the assignee of this patent application.

SUMMARY OF THE INVENTION

An embodiment of the invention is directed to a lighted gaming chair including a chair and enhanced visibility lighting. The chair has a seat portion and a back portion mounted with respect to the seat portion. The enhanced visibility lighting is attached to the chair. The enhanced visibility lighting includes a light source and a diffusion layer that substantially covers the light source. The light source has a first width. The diffusion layer has a second width that is more than two times the first width. Light emitted from the light source passes through the diffusion layer.

Another embodiment of the invention is directed to a method of illuminating a gaming chair. A gaming chair is provided with enhanced visibility lighting attached thereto. The enhanced visibility lighting includes a light source and a diffusion layer that substantially covers the light source. The light source has a first width. The diffusion layer has a second width that is more than two times the first width. Light is emitted from the light source. The enhanced visibility lighting causes the emitted light to appear as the emitted light is emitted from the light source having the second width.

Another embodiment of the invention is directed to lighted gaming furniture including furniture and enhanced visibility lighting. A person uses the furniture when playing a video game on a video gaming system. The enhanced visibility lighting is attached to the furniture. The enhanced visibility lighting includes a light source and a diffusion layer that substantially covers the light source. The light source has a first width. The diffusion layer has a second width that is more than two times the first width. Light emitted from the light source passes through the diffusion layer.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE INVENTION

Figure 1:
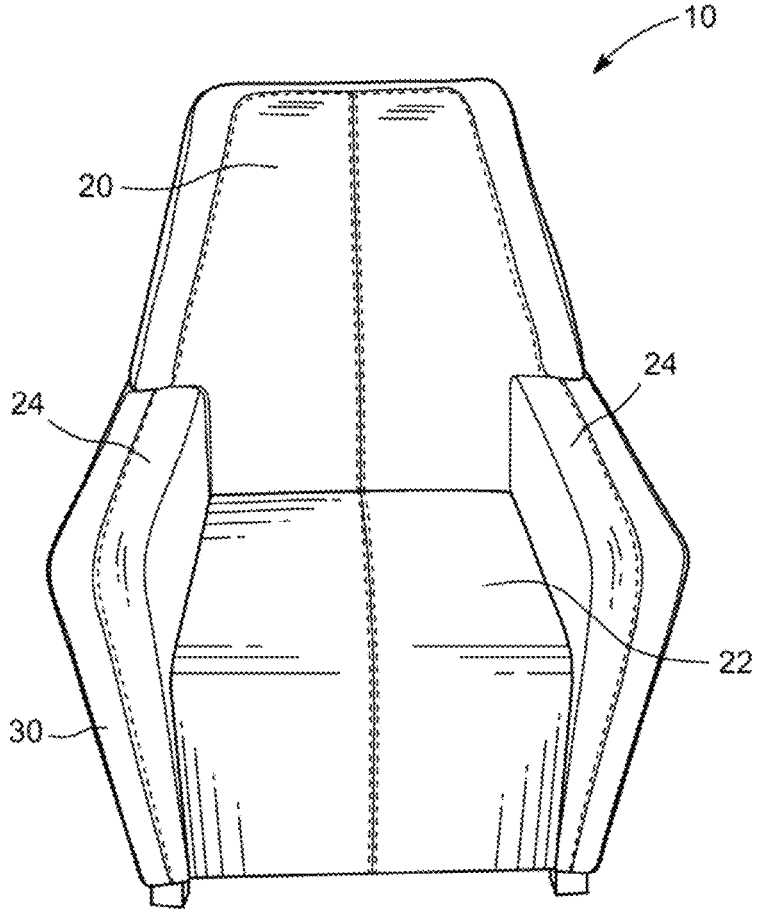
FIG. 1 is a front view of a gaming chair with enhanced visibility lighting according to an embodiment of the invention where the enhanced visibility lighting is not activated.
Figure 2:
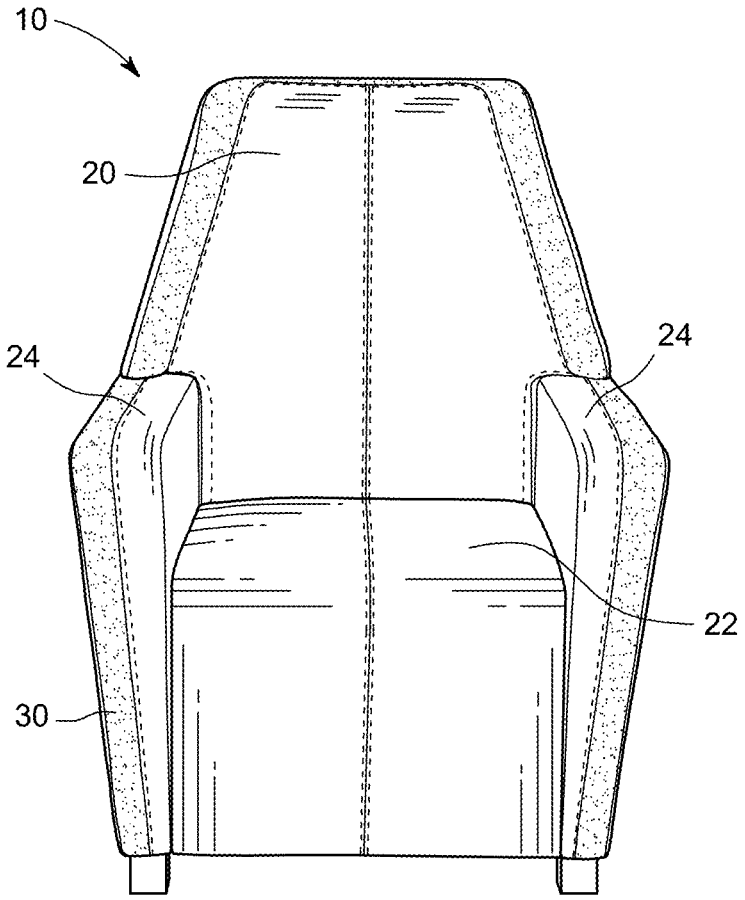
FIG. 2 is a front view of the lighted gaming chair of FIG. 1 with the enhanced visibility lighting activated as indicated by the speckles.

An embodiment of the invention is directed to a gaming chair with enhanced visibility lighting as illustrated at 10 in FIGS. 1 and 2. The enhanced visibility lighting thereby accents the shape and style of the lighted gaming chair and provides an aesthetic upgrade to the user experience.

The enhanced visibility lighting makes light that is emitted from individual spaced-apart light sources appear as the light is emitted from a single continuous light source. The enhanced visibility lighting also makes light emitted from a light source having a first width appear as though the light is emitted from a light source having a second width that is larger than the first width.

Based upon the preceding, "enhanced visibility" means that the ability of persons playing video games to see the light emitted from furniture on which the person is sitting is enhanced to thereby increase the immersiveness of the gaming experience. The enhanced visibility lighting also increases the ability of persons who are watching video gaming to see light emitting from furniture on which the person playing the video games is sitting to increase enjoyment associated with watching the video gaming.

Figure 19:
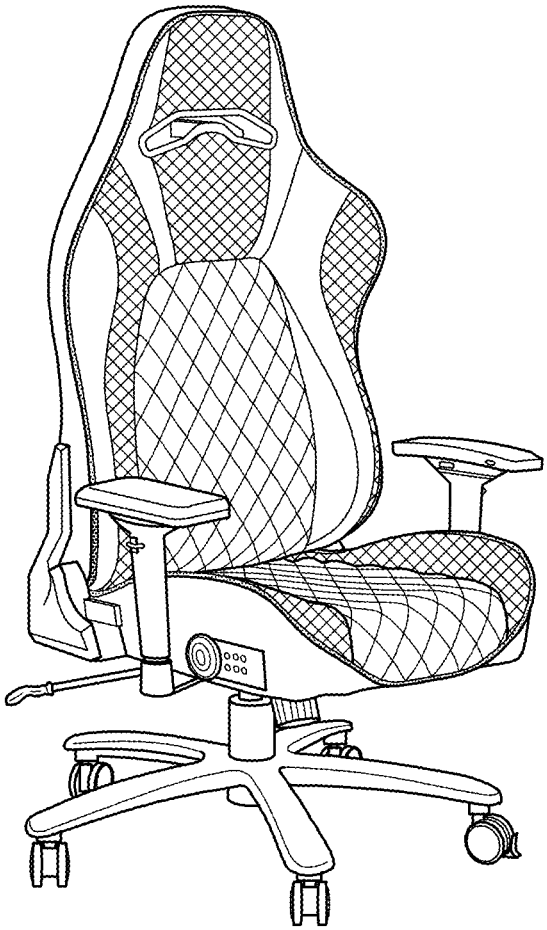
FIG. 19 PRIOR ART
FIG. 19 is a perspective view of a prior art lighted gaming chair having a lighting tube.

A significant benefit of the enhanced visibility lighting 30 is that the enhanced visibility lighting 30 achieves the preceding benefits using the same amount of energy as the prior art lighted gaming chairs such as illustrated in FIG. 19. This feature is particularly important when the components of the lighted gaming chair 10 such as the lighting and the sound are powered by batteries.

The enhanced visibility lighting outlines at least a portion of the lighted gaming chair 10. In certain embodiments, the enhanced visibility lighting 30 substantially outlines side and upper surfaces of the lighted gaming chair 10 such as illustrated in FIGS. 1 and 2.

The lighted gaming chair 10 on which the enhanced visibility lighting 30 is used may assume a variety of forms using the concepts of the invention. In one exemplary embodiment, the lighted gaming chair 10 includes a seat portion 20, a back portion 22 and arms 24 as illustrated in FIGS. 1 and 2.

The lighted gaming chair 10 may be covered with a variety of materials having a variety of colors depending on the market in which the lighted gaming chair 10 is intended to be sold such as upper, moderate and value priced. Examples of materials that may be used to cover the surfaces of the lighted gaming chair 10 include leather, vinyl and fabric.

In certain embodiments, the enhanced visibility lighting 30 is mounted on the front surface of the right arm 24 to extend from a lower surface thereof to an upper surface thereof. As used herein, front is a side of the back portion 22 that is typically in contact by a person sitting on the lighted gaming chair 10.

The enhanced visibility lighting 30 is mounted on an upper surface of the right arm 24 to extend from a front edge thereof to a back edge thereof. As used herein, upper is a direction away from a horizontal surface on which the lighted gaming chair 10 is placed.

The enhanced visibility lighting 30 is mounted on the front surface of the back portion 20 proximate a right edge thereof to extend from a lower edge thereof to an upper edge thereof. The enhanced visibility lighting 30 is mounted on the upper surface of the back portion 20 to extend from a right edge thereof to a left edge thereof. In other embodiments, the enhanced visibility lighting 30 is mounted on the front surface of the back portion 20 proximate the upper edge thereof and extends from the right edge thereof to the left edge thereof.

The enhanced visibility lighting 30 is mounted on the front surface of the back portion 20 proximate a left edge thereof to extend from an upper edge thereof to a lower edge thereof. The enhanced visibility lighting 30 is mounted on an upper surface of the left arm 24 to extend from a back edge thereof to a front edge thereof. The enhanced visibility lighting 30 is mounted on the front surface of the left side arm 24 to extend from an upper surface thereof to a lower surface thereof.

Figure 3:
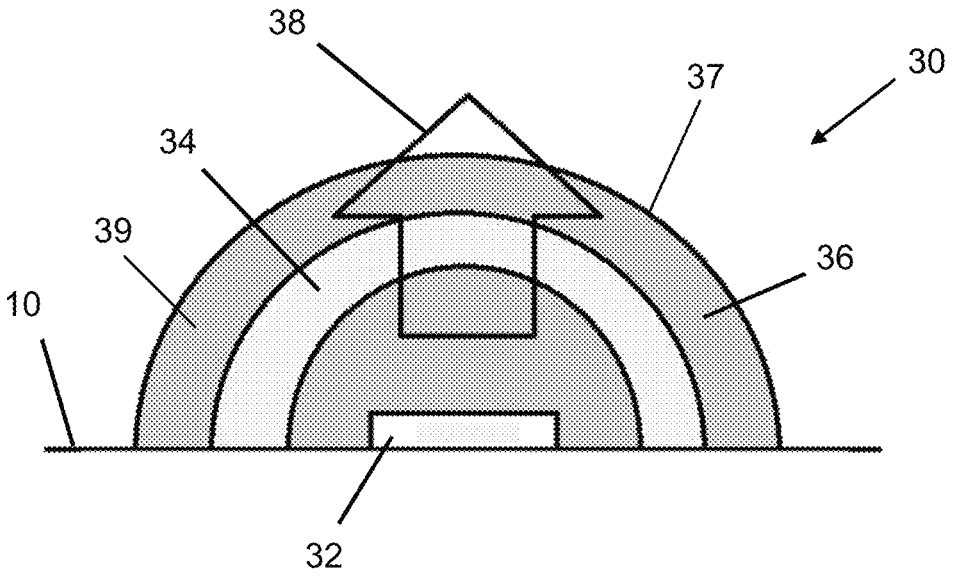
FIG. 3 is a sectional view of the enhanced visibility lighting of the lighted gaming chair illustrated in FIGS. 1 and 2 that depicts transmission of light through the enhanced visibility lighting and emitting of the light from the enhanced visibility lighting.

As illustrated in FIG. 3, the enhanced visibility lighting 30 generally includes a light source 32. In certain embodiments, the light source 32 has an elongated configuration and includes a plurality of light emitting elements such as LEDs. The light source 32 is mounted to a frame surface of the lighted gaming chair 10. A person of skill in the art will appreciate that the light source 32 may be fabricated from alternative materials using the concepts of the invention.

A diffusion layer 34 is placed over the light source 32. The diffusion layer 34 causes the light emitted from the light source 32 to be more diffuse and spread out to thereby enhance the visibility of the lighting. The diffusion layer 34 also masks the individual bulbs in the light source 32 to make the illumination appear to be relatively continuous in contrast to the light emitted from the individual bulbs in the light source 32.

In certain embodiments, the diffusion layer 34 is fabricated from a translucent material. An example of one suitable translucent material for fabricating the diffusion layer 34 is EPE foam. A person of skill in the art will appreciate that the diffusion layer 34 may be fabricated from alternative materials using the concepts of the invention.

In certain embodiments, the diffusion layer 34 has an at least partially semicircular outer surface as illustrated in FIG. 3. The thickness of the diffusion layer 34 may be selected based upon a variety of factors such as the light transmissiveness of the material used to fabricate the diffusion layer 34 and the desired width of the enhanced visibility lighting 30.

The diffusion layer 34 has a width that is more than two times the width of light source 32. In other embodiments, the width of the diffusion layer 34 is more than about five times the width of the light source 32. In still other embodiments, the width of the diffusion layer 34 is between about five and about twenty times the width of the light source 32.

The semicircular profile of the diffusion layer 34 also enhances the ability to see light emitted from the light source 32 from more directions as compared to if the light was emitted from along the surface of the lighted gaming chair 10. This feature is particularly beneficial to persons who are not directly in front of the lighted gaming chair 10.

Because of the greatly increased width of the light emitted from the enhanced visibility lighting 30 of this invention compared to the width of the LED light source on the prior art gaming chairs such as is illustrated in FIG. 19, the lighted gaming chair 10 with the enhanced visibility lighting 30 of this invention facilitates provides a more immersive experience when playing video games.

A masking effect can be further increased by placing a masking layer 36 over the diffusion layer 34. In certain embodiments, the masking layer 36 may include a gridded mesh layer 37 with a two-way reflective fabric 39 (light-transmissive retroreflective fabric) in between the gridded mesh layer 37 and the diffusion layer 34. The masking layer 36 may be selected to enhance the aesthetics of lighting while minimizing a decrease in the lumens transmitted therethrough. The masking layer 36 may also increase the durability of the lighted gaming chair 10 with enhanced visibility lighting 30 because the masking layer is more durable than the diffusion layer 34. Transmission of the light through the diffusion layer 34 and the masking layer 36 is illustrated by arrow 38 in FIG. 3.

In certain embodiments, the mounting of the enhanced visibility lighting 30 to the lighted gaming chair 10 enables a single light source to extend all the way around the lighted gaming chair 10. Such a configuration is desirable because it reduces complexity associated with connecting the components and controlling illumination of the lights.

In one configuration, the seat portion 22 and the back portion 20 of the lighted gaming chair 10 are attached together during the manufacturing process. In other embodiments of the lighted gaming chair 10, the light source used on the back portion 20 is separate from the light source used on the arms 24. This configuration may facilitate shipping the lighted gaming chair 10 in a more compact form with the back portion 20 detached from the seat portion 22 and the arms 24.

The invention thereby provides a seamless and attractive lighting finish that is brightly illuminated. The lights may be selected so that the lights are operable in a variety of colors. An example of one range of colors in which the lights may be illuminated includes red, orange, yellow, green, blue, indigo and violet. The lights may be operable in a single color at a time or may be operable in a gradient of colors with various patterns.

The lighted gaming chair 10 may include at least one speaker (not shown) that is capable of emitting sounds associated with the video game being played. In certain embodiments, the lighted gaming chair 10 includes a plurality of speakers.

The lighted gaming chair 10 may also include a vibration mechanism (not shown) that is capable of emitting vibrations that are associated with the video game being played. An example of one such device that is capable of emitting vibrations is a subwoofer. The vibration emitting mechanism may be linked to the at least one speaker, a controller or the gaming system.

The enhanced visibility lighting 30 may be operable in a variety of modes of operation. The user may utilize a variety of mechanisms to switch between the modes of operation. An example of one mechanism for controlling the operation of the enhanced visibility lighting 10 is an in-line switch that enables a person using the lighted gaming chair 10 to change at least one of a lighting pattern and a lighting color. Alternatively or additionally, the enhanced visibility lighting 30 may be controlled using an application on a mobile phone or using a webpage.

The enhanced visibility lighting 30 is connected to a power source and a controller. The controller controls illumination of the enhanced visibility lighting 30. The controller may also include the ability for the person playing the video game to change colors and/or patterns at which the lights are illuminated. Such control may be directly changed on the object or may be remotely controlled on a wireless remote or using an application on a mobile phone.

In other embodiments, the controller may be linked to the video game unit and/or the computer on which the video game is being played. Using such a configuration enables the enhanced visibility lighting 30 to be illuminated to correspond with aspects of the video game. The link between the controller and the video game unit and/or the computer may be wired or wireless.

Another embodiment of the invention is directed to office style gaming chairs 110 that are intended to be used by persons who are playing video games. The office style gaming chairs are illustrated at 110 in FIGS. 4 and 5.

Figure 4:
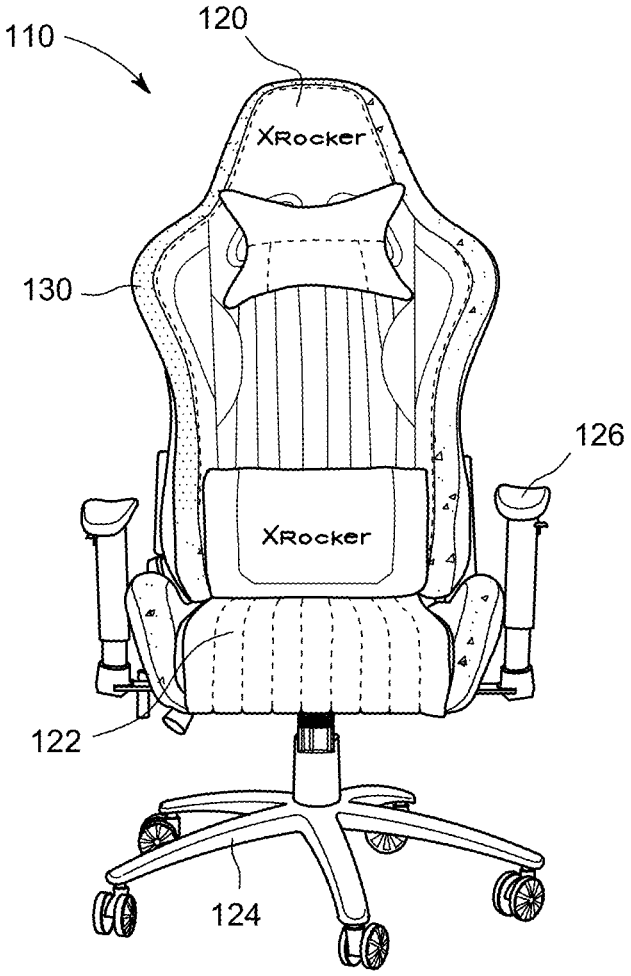
FIG. 4 is a front view of an alternative embodiment of the lighted office style gaming chair with enhanced visibility lighting.
Figure 5:
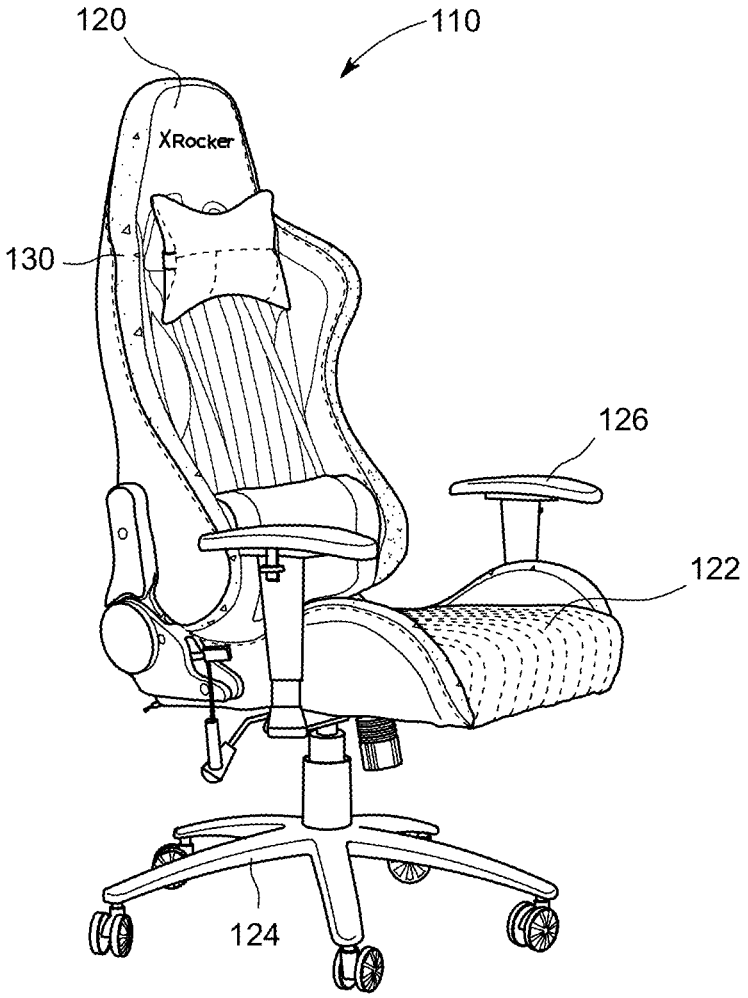
FIG. 5 is a portrait perspective view of the lighted office style gaming chair with enhanced visibility lighting of FIG. 4.

The enhanced visibility lighting 130 outlines at least a portion of the office style gaming chair 110. In certain embodiments, the enhanced visibility lighting 130 substantially outlines side and upper surfaces of the office style gaming chair 110 such as illustrated in FIGS. 4 and 5.

The office style gaming chair 110 generally includes a back portion 120, a seat portion 122 and a base portion 124. The office style gaming chair 110 may also include at least one arm 126.

In certain embodiments, the back portion 120 is oriented generally transverse to the seat portion 122. An orientation of the back portion 120 with respect to the seat portion 122 may be adjustable. In certain embodiments, the angle between the back portion 120 and the seat portion 122 may be between about 60 degrees and about 180 degrees.

The office style gaming chair 110 may be covered with a variety of materials having a variety of colors depending on the market in which the office style gaming chair 110 is intended to be sold such as upper, moderate and value priced. Examples of materials that may be used to cover the surfaces of the office style gaming chair 110 include leather, vinyl and fabric.

The base portion 124 may include a plurality of wheels that are mounted in a spaced-apart configuration. The wheels enable the office style gaming chair 110 to be rolled to a use location while a person is sitting on the office style gaming chair 110.

The office style gaming chair 110 includes the enhanced visibility lighting 130 positioned on a surface thereof that are capable of being selectively illuminated while the person is playing the video game while sitting on the office style gaming chair 110.

In certain embodiments, the enhanced visibility lighting 130 is mounted on the front surface of the seat portion 122 to extend from a lower surface thereof to an upper surface thereof. As used herein, front is a side of the back portion 122 that is typically in contact by a person sitting on the office style gaming chair 110.

The enhanced visibility lighting 130 is mounted on an upper surface of the seat portion 122 to extend from a front edge thereof to a back edge thereof. As used herein, upper is a direction away from a horizontal surface on which the office style gaming chair 110 is placed.

The enhanced visibility lighting 130 is mounted on the front surface of the back portion 120 proximate a right edge thereof to extend from a lower edge thereof to an upper edge thereof. The enhanced visibility lighting 130 is mounted on the upper surface of the back portion 120 to extend from a right edge thereof to a left edge thereof. The enhanced visibility lighting 130 is mounted on the front surface of the back portion 120 proximate a left edge thereof to extend from an upper edge thereof to a lower edge thereof.

The enhanced visibility lighting 130 is mounted on an upper surface of the seat portion 122 to extend from a back edge thereof to a front edge thereof. The enhanced visibility lighting 130 is mounted on the front surface of the seat portion 122 to extend from an upper surface thereof to a lower surface thereof.

A significant benefit of the enhanced visibility lighting 130 is that the enhanced visibility lighting 130 does not consume any additional energy as compared to the prior art light gaming chair such as illustrated in FIG. 19. This feature is particularly important when the components of the office style gaming chair 110 such as the lighting and the sound are powered by batteries.

Figure 6:
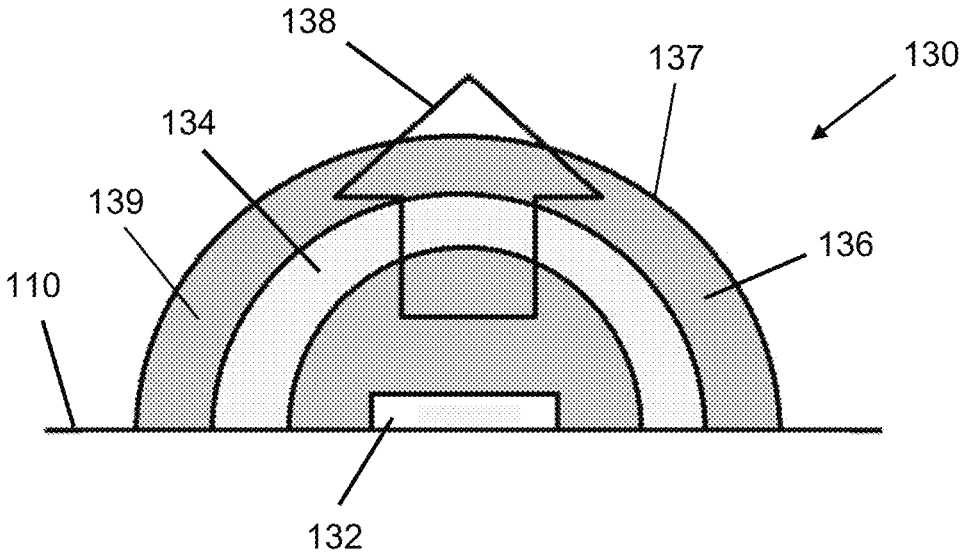
FIG. 6 is a sectional view of the enhanced visibility lighting of the lighted gaming chair illustrated in FIGS. 4 and 5 where an upper surface of the enhanced visibility lighting has a curved configuration.

Similar to the embodiment illustrated in FIG. 3, the enhanced visibility lighting 130 generally includes a light source 132 as illustrated in FIG. 6. In certain embodiments, the light source 132 has a plurality of light emitting elements such as LEDs that are mounted to a surface of the office style gaming chair 110. A person of skill in the art will appreciate that the light source 132 may be fabricated from alternative materials using the concepts of the invention.

A diffusion layer 134 is placed over the light source 132. The diffusion layer 134 causes the light emitted from the light source 132 to be more diffuse and spread out to thereby enhance the visibility of the lighting. The diffusion layer 134 also masks the individual bulbs in the light source 132 to make the illumination appear to be relatively continuous in contrast to the light emitted from the individual bulbs in the light source 132.

In certain embodiments, the diffusion layer 134 is fabricated from a translucent material. An example of one suitable translucent material for fabricating the diffusion layer 134 is EPE foam. A person of skill in the art will appreciate that the diffusion layer 134 may be fabricated from alternative materials using the concepts of the invention.

In certain embodiments, the diffusion layer 134 has an at least partially semicircular outer surface. The diffusion layer 134 has a width that is more than two times the width of light source 132. In other embodiments, the width of the diffusion layer 132 is more than about five times the width of the light source 132. In still other embodiments, the width of the diffusion layer 134 is between about five and about twenty times the width of the light source 132.

In certain embodiments, the mounting of the enhanced visibility lighting 130 to the office style gaming chair 110 enables a single light source 132 to extend around the office style gaming chair 110. Such a configuration is desirable because it reduces complexity associated with connecting the components and controlling illumination of the lights.

In other embodiments of the office style gaming chair 110, the light source 132 used on the back portion 120 is separate from the light source used on the seat portion 122. This configuration may facilitate shipping the office style gaming chair 110 in a more compact form with the back portion 120 detached from the seat portion 122.

Because of the greatly increased width of the light emitted from the enhanced visibility lighting 130 of this invention compared to the width of the light sources on the prior art gaming chairs such as is illustrated in FIG. 19, the office style gaming chair 110 with the enhanced visibility lighting 130 of this invention provides a more immersive experience when playing video games.

A masking effect can be further increased by placing a masking layer 136 over the diffusion layer 134. In certain embodiments, the masking layer 136 may include a gridded mesh layer 137 with a two-way reflective fabric 139 (light-transmissive retroreflective fabric) in between the gridded mesh layer 137 and the diffusion layer 139. The masking layer 136 not only enhances the aesthetics of lighting while minimizing a decrease in the lumens transmitted therethrough. The masking layer 136 may also increase the durability of the office style gaming chair 110 with enhanced visibility lighting 130 because the masking layer 136 is more durable than the diffusion layer 134. Transmission of the light through the diffusion layer 134 and the masking layer 136 is illustrated by arrow 138 in FIG. 6.

The invention thereby provides a seamless and attractive lighting finish that is brightly illuminated. The lights may be selected so that the lights are operable in a variety of colors. An example of one range of colors in which the lights may be illuminated includes red, orange, yellow, green, blue, indigo and violet. The lights may be operable in a single color at a time or may be operable in a gradient of colors.

The office style gaming chair 110 may include at least one speaker (not shown) that is capable of emitting sounds associated with the video game being played. In certain embodiments, the office style gaming chair 110 includes a plurality of speakers.

The office style gaming chair 110 may also include a vibration mechanism (not shown) that is capable of emitting vibrations that are associated with the video game being played. An example of one such device that is capable of emitting vibrations is a subwoofer. The vibration emitting mechanism may be linked to the at least one speaker, a controller or the gaming system.

The enhanced visibility lighting 130 may be operable in a variety of modes of operation. The user may utilize a variety of mechanisms to switch between the modes of operation. An example of one mechanism for controlling the operation of the enhanced visibility lighting 130 is an in-line switch that enables a person using the office style gaming chair 110 to change at least one of a lighting pattern and a lighting color. Alternatively or additionally, the enhanced visibility lighting 130 may be controlled using an application on a mobile phone or using a webpage.

Using a manner that is similar to the manner described with respect to the preceding embodiment of the invention, the enhanced visibility lighting 130 are connected to a power source and a controller. The controller controls illumination of the enhanced visibility lighting 150. The controller may also include the ability for the person playing the video game to change colors and/or patterns at which the lights are illuminated. Such control may be directly changed on the object or may be remotely controlled on a wireless remote or using an application on a mobile phone.

In other embodiments, the controller may be linked to the video game unit and/or the computer on which the video game is being played. Using such a configuration enables the enhanced visibility lighting 130 to be illuminated to correspond with aspects of the video game. The link between the controller and the video game unit and/or the computer may be wired or wireless.

Figure 7:
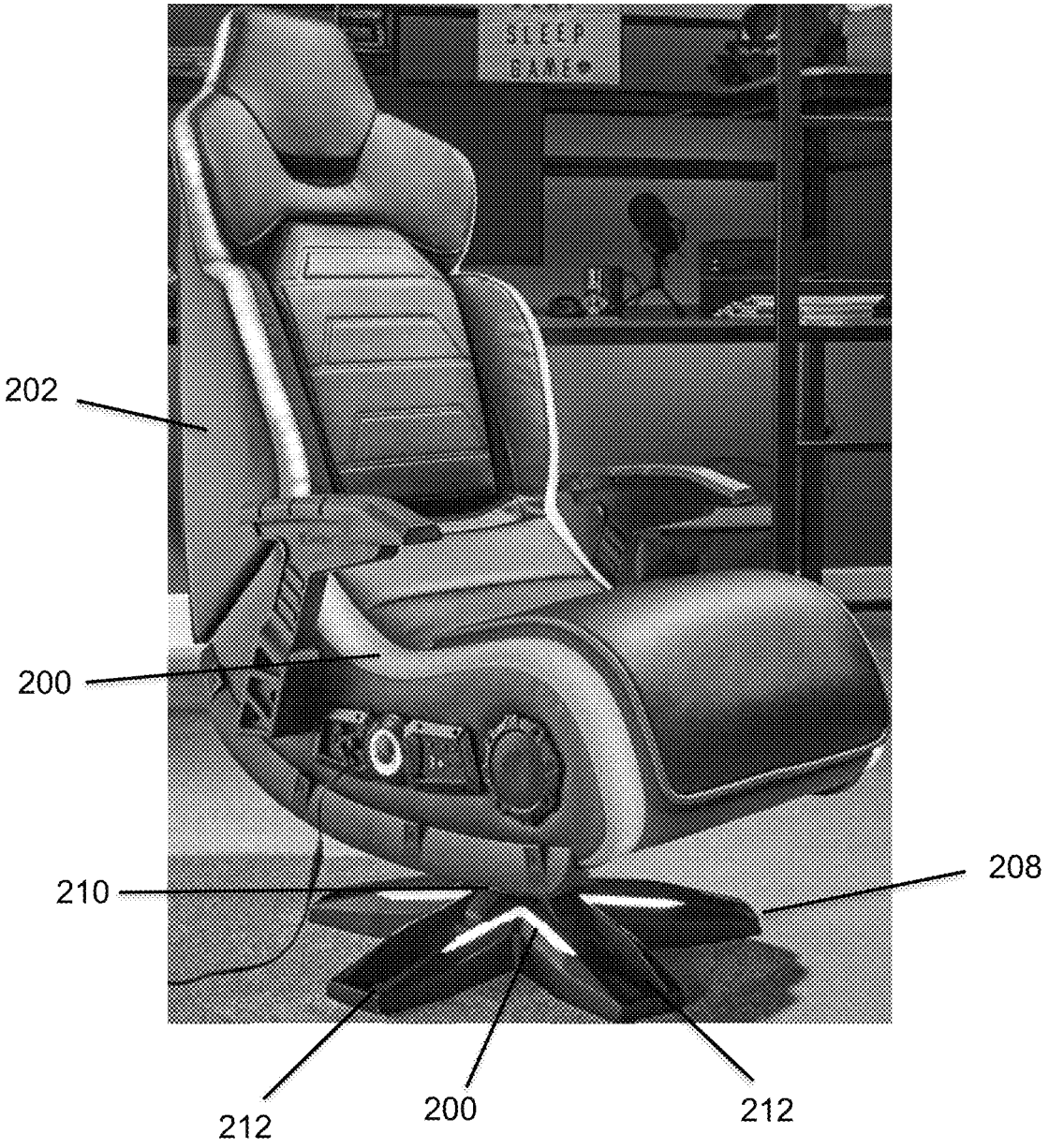
FIG. 7 is a perspective view of another configuration of a lighted gaming chair with enhanced visibility lighting and a lighted chair base where an upper surface of the enhanced visibility lighting has a flat configuration.

Another configuration of the enhanced visibility lighting 200 is illustrated on a gaming chair 202 in FIG. 7. This embodiment of the enhanced visibility lighting 200 provides the same benefits as the enhanced visibility lighting described with respect to FIGS. 1-3. However, an upper surface of the enhanced visibility lighting 200 is generally flat. Such a configuration is contrasted from the curved upper surface of the enhanced visibility lighting 200 illustrated in FIG. 3. A person of skill in the art will appreciate that the concepts of the invention may be adapted for use with the enhanced visibility lighting having an outer surface with a curvature that is more than the generally flat configuration illustrated in FIGS. 9 and 10 and less than the configuration illustrated in FIG. 3.

The lighted gaming chair 202 may have a variety of shapes using the concepts of the invention and may be covered with a variety of materials having a variety of colors depending on the market in which the lighted gaming chair 202 is intended to be sold such as upper, moderate and value priced. Examples of materials that may be used to cover the surfaces of the lighted gaming chair 202 include leather, vinyl and fabric.

Figure 8:
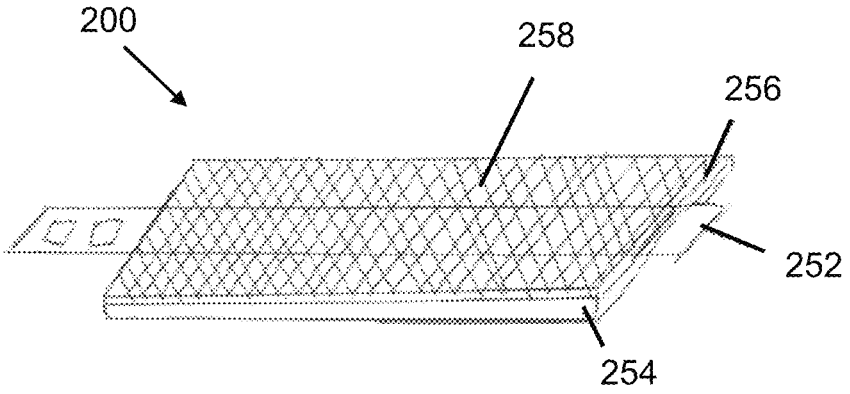
FIG. 8 is a perspective view of the flat configuration of the enhanced visibility lighting.
Figure 9:
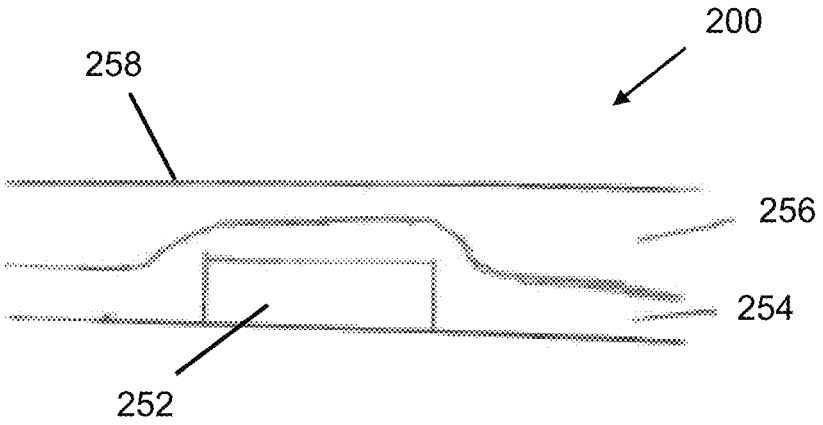
FIG. 9 is an end view of the flat configuration of the enhanced visibility lighting.

As illustrated in FIGS. 8 and 9, the enhanced visibility lighting 200 generally includes a light source 252. In certain embodiments, the light source 252 has an elongated configuration and includes a plurality of light emitting elements such as LEDs. A person of skill in the art will appreciate that the light source 252 may be fabricated from alternative materials using the concepts of the invention. While it is illustrated that the upper surface of the enhanced visibility lighting 200 is generally flat, the upper surface of the light source 252 does not need to be generally flat as illustrated in FIGS. 8 and 9.

A diffusion layer 254 is placed over the light source 252. The diffusion layer 254 causes the light emitted from the light source 252 to be more diffuse and spread out to thereby enhance the visibility of the lighting. The diffusion layer 254 also masks the individual bulbs in the light source 252 to make the illumination appear to be relatively continuous in contrast to the light emitted from the individual bulbs in the light source 252.

In certain embodiments, the diffusion layer 254 is fabricated from a translucent material. An example of one suitable translucent material for fabricating the diffusion layer 254 is EPE foam. A person of skill in the art will appreciate that the diffusion layer 254 may be fabricated from alternative materials using the concepts of the invention.

In certain embodiments, at least a portion of the diffusion layer 254 that extends over the light source 252 is generally planar as illustrated in FIGS. 8 and 9. As illustrated in FIG. 9, the upper surface of the diffusion layer 254 may decrease in thickness for the portion of the diffusion layer 94 that is not over the light source 252. This configuration causes the light that is transmitted to the upper surface of the enhanced visibility lighting 200 to have a similar intensity across the width of the enhanced visibility lighting 200.

The thickness of the diffusion layer 254 may be selected based upon a variety of factors such as the light transmissiveness of the material used to fabricate the diffusion layer 254 and the desired width of the enhanced visibility lighting 80.

The diffusion layer 254 has a width that is more than two times the width of light source 252. In other embodiments, the width of the diffusion layer 254 is more than about three times the width of the light source 252. In still other embodiments, the width of the diffusion layer 254 is between about five and about twenty times the width of the light source 252.

In situations where the upper surface of the diffusion layer 254 is not flat, as illustrated in FIG. 9, the enhanced visibility lighting 200 may include a cover layer 256 that is placed over the diffusion layer 254. The cover layer 256 may be fabricated from a generally transparent material. The upper surface of the cover layer 256 may be substantially flat across a width of the enhanced visibility lighting 200 as illustrated in FIG. 9.

Because of the greatly increased width of the light emitted from the enhanced visibility lighting 200 of this invention compared to the width of the LED light source on the prior art gaming chairs such as is illustrated in FIG. 19, the lighted gaming chair with the enhanced visibility lighting 200 of this invention provides a more immersive experience when playing video games.

A masking effect can be further increased by placing a masking layer 258 over the cover layer 256. In certain embodiments, the masking layer 258 may include a gridded mesh layer with a two-way reflective fabric (light-transmissive retroreflective fabric) in between similar to the embodiment illustrated in FIG. 3. The masking layer 258 may be selected to enhance the aesthetics of lighting while minimizing a decrease in the lumens transmitted therethrough. The masking layer 258 may also increase the durability of the lighted gaming chair with enhanced visibility lighting 200 because the masking layer is more durable than the diffusion layer 254.

The invention thereby provides a seamless and attractive lighting finish that is brightly illuminated. The lights may be selected so that the lights are operable in a variety of colors. An example of one range of colors in which the lights may be illuminated includes red, orange, yellow, green, blue, indigo and violet. The lights may be operable in a single color at a time or may be operable in a gradient of colors and animated patterns.

The lighted gaming chair 202 may include at least one speaker (not shown) that is capable of emitting sounds associated with the video game being played. In certain embodiments, the lighted gaming chair 202 includes a plurality of speakers.

The lighted gaming chair 202 may also include a vibration mechanism (not shown) that is capable of emitting vibrations that are associated with the video game being played. An example of one such device that is capable of emitting vibrations is a subwoofer. The vibration emitting mechanism may be linked to the at least one speaker, a controller or the gaming system.

The enhanced visibility lighting 200 may be operable in a variety of modes of operation. The user may utilize a variety of mechanisms to switch between the modes of operation. An example of one mechanism for controlling the operation of the enhanced visibility lighting 200 is an in-line switch that enables a person using the lighted gaming chair 202 to change at least one of a lighting pattern and a lighting color. Alternatively or additionally, the enhanced visibility lighting 200 may be controlled using an application on a mobile phone or using a webpage.

Using a manner that is similar to the manner described with respect to the preceding embodiments of the invention, the enhanced visibility lighting 200 are connected to a power source and a controller. The controller controls illumination of the enhanced visibility lighting 200. The controller may also include the ability for the person playing the video game to change colors and/or patterns at which the lights are illuminated. Such control may be directly changed on the object or may be remotely controlled on a wireless remote or using an application on a mobile phone.

In other embodiments, the controller may be linked to the video game unit and/or the computer on which the video game is being played. Using such a configuration enables the enhanced visibility lighting 200 to be illuminated to correspond with aspects of the video game. The link between the controller and the video game unit and/or the computer may be wired or wireless.

Another embodiment of the invention is directed to a lighted chair base 208 for the gaming chair 202 illustrated in FIG. 7. The lighted chair base 208 may be used on a variety of styles of chairs such as the office style gaming chair 110 illustrated in FIGS. 4 and 5.

The lighted gaming chair 202 may be covered with a variety of materials having a variety of colors depending on the market in which the lighted gaming chair 202 is intended to be sold such as upper, moderate and value priced. Examples of materials that may be used to cover the surfaces of the lighted gaming chair 202 include leather, vinyl and fabric.

The lighted chair base 208 may have a variety of configurations using the concepts of the invention. In certain embodiments, the lighted chair base 208 includes a central hub 210 from which a plurality of legs 212 extend radially therefrom. In certain embodiments, there are five legs 212 that extend from the hub 210.

While it is illustrated that each of the legs 212 has a similar size and shape, at least a portion of the legs 212 may be formed with a different size and/or shape. Similarly, while it is illustrated that a spacing between each of the legs 212 is approximately equal, it is possible for the legs 212 to extend from the hub 210 so that the spacing between adjacent legs 212 is not approximately equal.

At least a portion of the legs 212 has enhanced visibility lighting 200 associated therewith. In certain embodiments, all of the legs 212 have the enhanced visibility lighting 200. In other embodiments, each of the legs 212 includes more than one of the enhanced visibility lighting 200 associated therewith. For example, the enhanced visibility lighting 200 may be provided on opposite sides of each leg 212 proximate an upper surface thereof.

While FIG. 7 illustrates that the enhanced visibility lighting 200 extends only a portion of each leg 212, in other configurations, the enhanced visibility lighting 200 extends substantially along a length of each length.

A benefit of positioning the enhanced visibility lighting 200 on the legs 212 proximate the hub 210 is that it is less likely for a person to step on the enhanced visibility lighting 200 while using the lighted gaming chair 202. Even though the enhanced visibility lighting 200 is configured to resist damage resulting from a person's foot placed thereon, configuring the enhanced visibility lighting 200 to reduce the potential of the person's foot from contacting the enhanced visibility lighting 200 may be beneficial.

In certain embodiments, the enhanced visibility lighting 200 extends from one of the legs 212 onto an adjacent leg 212, as illustrated in FIG. 7. Using such a configuration may reduce the separate sections of the enhanced visibility lighting 200, which simplifies the wiring associated with the enhanced visibility lighting 200.

Figure 10:
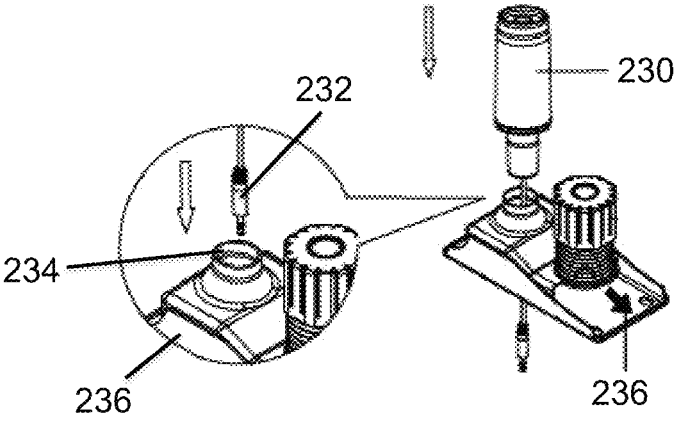
FIG. 10 is a first step in attachment of the lighted chair base to the lighted gaming chair.

The enhanced visibility lighting 200 generally includes LED or similar light source 222 as illustrated in FIG. 10. In certain embodiments, the light source 222 is mounted in a spaced apart configuration. The number and type of light sources 222 may be selected based upon a variety of factors.

A diffusion layer 224 is provided over at least a portion of the light source 222 and a diffusion layer 224. In certain embodiments, the diffusion layer 224 substantially covers the light source 222. Similar to the other embodiments described in this patent application, the diffusion layer 224 masks the light emitted from individual elements of the light source 222 such that it appears that the light is emitted from a single continuous light source as opposed to a plurality of spaced-apart lights in the light source 222.

The diffusion layer 224 also causes the light emitted from the light source 222 to appear as coming from a considerably wider light source as opposed to the light source 222, which have a width that is in certain embodiments less than half of the width of the diffusion layer 224.

The enhanced visibility lighting 200 may also include an outer layer 226 that at least partially extends over the diffusion layer 224. In certain embodiments, the outer layer 226 substantially covers the diffusion layer 224.

The outer layer 226 may be fabricated from a generally transparent material. The outer layer 226 thereby protects the diffusion layer 224 from damage during use of the lighted gaming chair 202. The outer layer 226 may be fabricated from a rubberized material. As used herein, rubberized material means that when a person places his/her foot on the enhanced visibility lighting 200, the person's foot resists slipping with respect to the leg 212. A thickness of the outer layer 226 may be selected based upon factors such as the desired width of the enhanced visibility lighting 310.

Each leg 212 may include a channel (not shown) formed therein that is adapted to receive at least a portion of the enhanced visibility lighting 200. In certain embodiments, the channel receives substantially all of the enhanced visibility lighting 200 such that an outer surface of the enhanced visibility lighting 200 is approximately in alignment with an upper surface of the leg 212 in which the enhanced visibility lighting 200 is mounted.

Mounting the enhanced visibility lighting 200 in this manner facilitates persons who are sitting at the lighted gaming chair 202 seeing light that is emitted from the enhanced visibility lighting 200 while at the same time protecting the enhanced visibility lighting 200 from damage while the lighted gaming chair 202 is being used such as when playing video games.

Because the lighted gaming chair 202 is rotatable with respect to the lighted chair base 208, power for the enhanced visibility lighting 200 that is associated with the lighted chair base 208 is preferably provided through a piston 230 that attaches the lighted gaming chair 202 to the lighted chair base 208.

Figure 11:
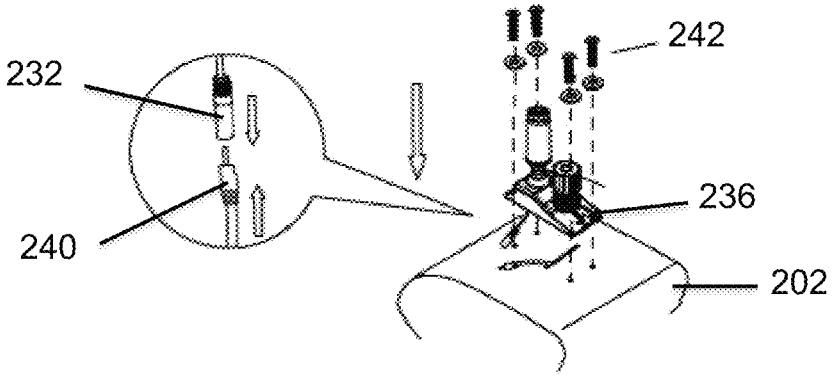
FIG. 11 is a second step in attachment of the lighted chair base to the lighted gaming chair.

The piston 230 includes an opening extending therethrough through which a piston power cord 232 is extended. The piston power cord 232 is extended through an opening 234 in mounting bracket 236 to which the piston 230 is attached as illustrated in FIG. 10. The piston power cord 232 is attached to a chair power cord 240 as illustrated in FIG. 11. The mounting bracket 236 is then attached to a lower surface of the lighted gaming chair 202 using a plurality of fasteners 242.

Figure 12:
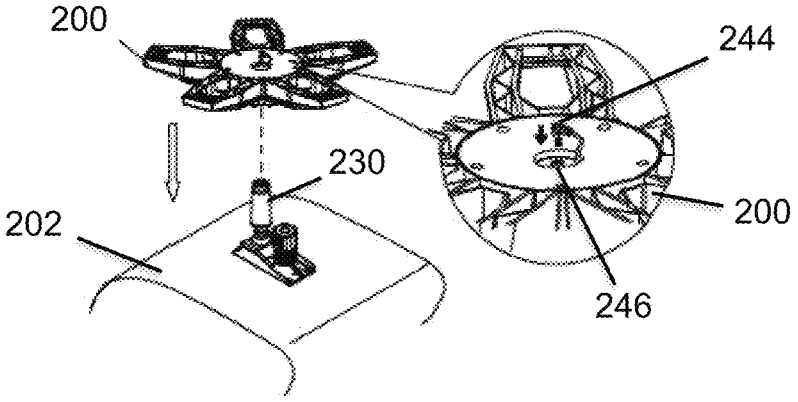
FIG. 12 is a third step in attachment of the lighted chair base to the lighted gaming chair.

Next, the lighted chair base 208 is attached to an end of the piston 230 that is opposite the lighted gaming chair 202. A base plug 244 from the lighted chair base 208 is plugged into a piston power cord plug 246 that is opposite the lighted gaming chair 202 as illustrated in FIG. 12.

The base plug 244 and the piston power cord plug 246 to which the base plug 244 is attached are both circular. This connection thereby enables the lighted gaming chair 202 to freely rotate with respect to the lighted chair base 208 while maintaining the electrical connection between the lighted gaming chair 202 and the lighted chair base 208 so that the enhanced visibility lighting 200 in the lighted chair base 208 can remain illuminated.

The lighted gaming chair 202 may include at least one speaker (not shown) that is capable of emitting sounds associated with the video game being played. In certain embodiments, the lighted gaming chair 202 includes a plurality of speakers.

The lighted gaming chair 202 may also include a vibration mechanism (not shown) that is capable of emitting vibrations that are associated with the video game being played. An example of one such device that is capable of emitting vibrations is a subwoofer. The vibration emitting mechanism may be linked to the at least one speaker, a controller or the gaming system.

In use, the enhanced visibility lighting 200 of the lighted gaming chair 202 may be illuminated in a variety of colors and light patterns. Similar to the enhanced visibility lighting in the other embodiments described in this application, the configuration of the enhanced visibility lighting 200 not only causes the light emitted from a plurality of lighting sources to be diffused such that the light appears to be emitted from a single continuous light source but the invention also causes the light to be emitted over the width of the enhanced visibility lighting 200.

Such lighting results are superior to the prior art lighted gaming chairs and furniture, which thereby increases the immersive experience of the gaming not only for the person who is playing the video game but also for persons who are watching the person who is playing the video games.

Illumination of the enhanced visibility lighting 200 may be synchronized with the illumination of the enhanced visibility lighting in other components such as the enhanced visibility lighting on the upper part of the lighted gaming chair, which is discussed with respect to FIGS. 1-3. Alternatively, the illumination of the enhanced visibility lighting 200 may be controlled separately than the other illuminated components being used while playing video games.

The enhanced visibility lighting 200 may be operable in a variety of modes of operation. The user may utilize a variety of mechanisms to switch between the modes of operation. An example of one mechanism for controlling the operation of the enhanced visibility lighting 200 is an in-line switch that enables a person using the lighted gaming chair 202 to change at least one of a lighting pattern and a lighting color. Alternatively or additionally, the enhanced visibility lighting 200 may be controlled using an application on a mobile phone or using a webpage.

Using a manner that is similar to the manner described with respect to the preceding embodiments of the invention, the enhanced visibility lighting 200 are connected to a power source and a controller. The controller controls illumination of the enhanced visibility lighting 200. The controller may also include the ability for the person playing the video game to change colors and/or patterns at which the lights are illuminated. Such control may be directly changed on the object or may be remotely controlled on a wireless remote or using an application on a mobile phone.

In other embodiments, the controller may be linked to the video game unit and/or the computer on which the video game is being played. Using such a configuration enables the enhanced visibility lighting 200 to be illuminated to correspond with aspects of the video game. The link between the controller and the video game unit and/or the computer may be wired or wireless.

In addition to the two styles of chairs discussed in this application, the enhanced visibility lighting may be adapted for use in conjunction with other types of furniture, examples of which include pedestal mounted furniture, floor furniture, tables, desks, bed headboards, bed frames, sofa style seating, ottomans and office furniture. While each of the preceding items includes a frame, it is also possible to use the enhanced visibility lighting in conjunction with frameless furniture such as bean bag chairs.

Figure 13:
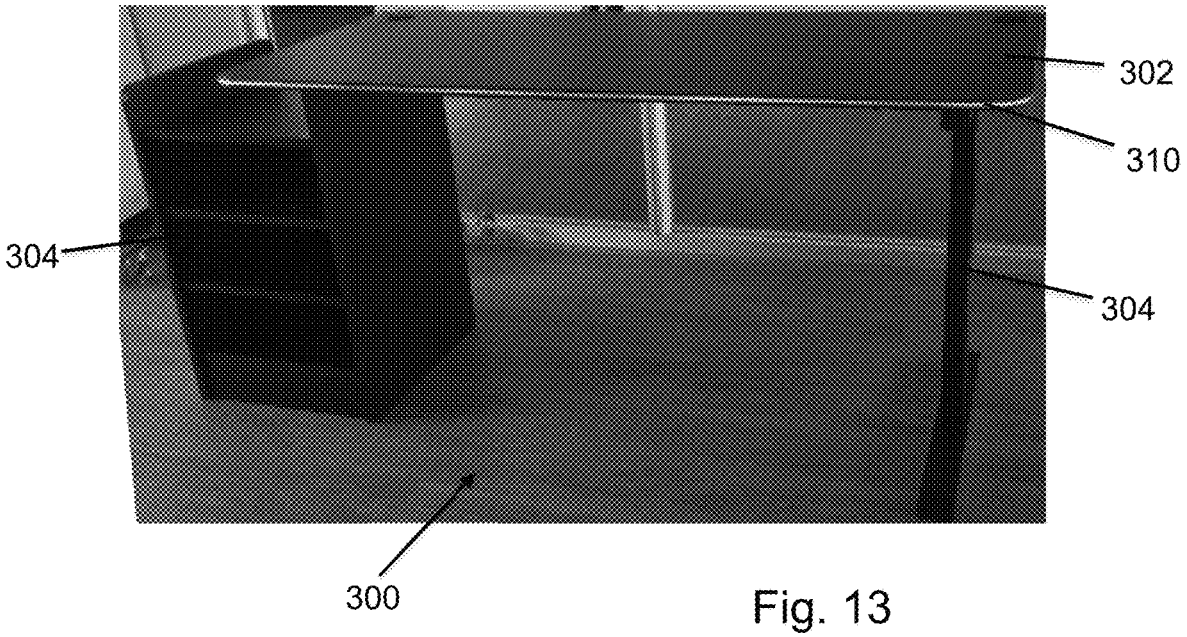
FIG. 13 is a perspective view of a lighted gaming desk with enhanced visibility lighting having a tubular configuration.

An example of one such alternative furniture object is a lighted gaming desk 300, which is illustrated in FIG. 13. The lighted gaming desk 300 generally includes a desk top 302 and a desk base 304 that is attached to the desk top 302 to maintain the desk top 302 in a generally horizontal orientation above a ground surface.

A person of skill in the art will appreciate that the desk top 302 may assume a variety of configuration using the embodiments of the invention. In certain embodiments, the desk top 302 has a generally rectangular configuration as illustrated in FIG. 13.

Similarly, the desk base 304 may have a variety of configurations using the embodiments of the invention. As illustrated in FIG. 13, proximate the right edge of the lighted gaming desk 300, the desk base 304 in in the configuration of a generally vertically oriented post with a support at a lower end thereof to stabilize the lighted gaming desk 300.

The desk base 304 proximate a left edge of the lighted gaming desk 300 includes two vertically oriented supports between which are mounted a plurality of shelves. While not illustrated, the desk base 304 may include at least one drawer.

The desk top 302 and the desk base 304 may be fabricated from and/or covered with a variety of materials having a variety of colors depending on the market in which the lighted gaming desk 300 is intended to be sold such as upper, moderate and value priced.

Figure 14:
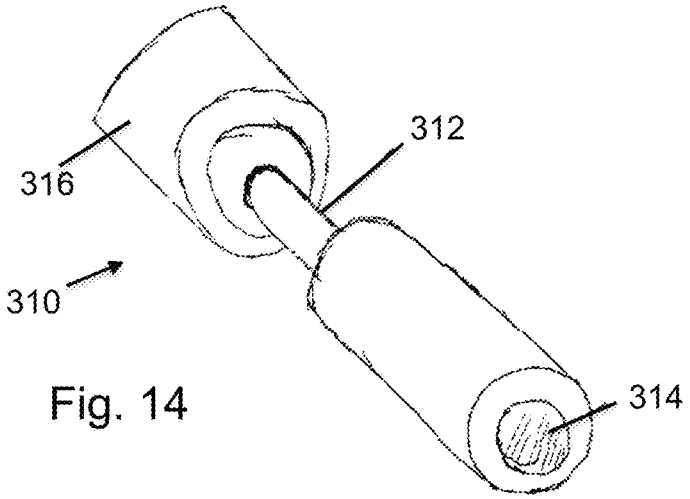
FIG. 14 is a perspective view of the tubular enhanced visibility lighting for the lighted gaming desk.

The enhanced visibility lighting 310 may have a generally circular profile as illustrated in FIG. 14. Proximate a center of the enhanced visibility lighting 310, LED or similar light source 312 are mounted in a spaced apart configuration. The number and type of light source 312 may be selected based upon a variety of factors.

A diffusion layer 314 is provided over at least a portion of the light source 312. A benefit of providing the diffusion layer 314 that extends substantially around the light source 312 is that when the enhanced visibility lighting 310 is attached to the desk top 302, as described in detail herein, it is not necessary for the enhanced visibility lighting 310 to have a particular orientation for maximizing the visibility of the light emitted from the enhanced visibility lighting 310.

Similar to the other embodiments described in this patent application, the diffusion layer 314 masks the light emitted from individual elements of the light source 312 such that it appears that the light is emitted from a single continuous light source as opposed to a plurality of spaced-apart lights in the light source 312. The diffusion layer 314 also causes the light emitted from the light source 312 to appear as coming from a considerably wider light source as opposed to the light source 312, which have a width that is in certain embodiments less than half of the width of the diffusion layer 314.

The enhanced visibility lighting 310 may also include an outer layer 316 that at least partially extends over the diffusion layer 314. In certain embodiments, the outer layer 316 extends substantially around the diffusion layer 314 so that an outer surface of the outer layer 316 has a generally circular profile.

The outer layer 316 may be fabricated from a generally transparent material. The outer layer 316 thereby protects the diffusion layer 314 from damage during use of the lighted gaming desk 300. A thickness of the outer layer 316 may be selected based upon factors such as the desired width of the enhanced visibility lighting 310.

In certain embodiments, the light source 312, the diffusion layer 314 and the outer layer 316 are each pliant or bendable so that the enhanced visibility lighting 310 can bend around the corners of the desk top 302.

Depending on the size of the lighted gaming desk 300 and, as such, the length of the enhanced visibility lighting 310, more than one light source may be used. In certain embodiments, there are two light sources (not shown) that are located on opposite side edges of the desk top 302. These light sources may be mounted on a lower surface of the desk top 302. In other embodiments, the light sources are at least partially recessed in the desk top 302 from a lower surface thereof. Recessing the light sources in the desk top 302 not only protects the light sources from damage but also enhances the aesthetics of the lighted gaming desk 300.

Figure 15:
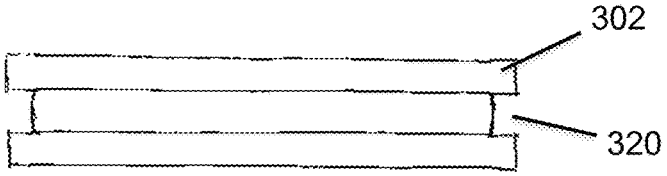
FIG. 15 is a side view of an edge of the top of the lighted gaming desk with the enhanced visibility lighting.

The desk top 302 may include a channel 320 formed in an edge thereof as illustrated in FIG. 15. The channel 320 is adapted to receive at least a portion of the enhanced visibility lighting 310. In certain embodiments, the channel 320 receives substantially all of the enhanced visibility lighting 310 such that an outer surface of the enhanced visibility lighting 310 is approximately in alignment with the edge of the desk top 302. The concepts of this embodiment are adaptable to other flat-packed furniture types.

Mounting the enhanced visibility lighting 310 in this manner facilitates persons who are sitting at the lighted gaming desk 300 seeing light that is emitted from the enhanced visibility lighting 310 while at the same time protecting the enhanced visibility lighting 310 from damage while the lighted gaming desk 300 is being used such as when playing video games.

The lighted gaming desk 300 may include at least one speaker (not shown) that is capable of emitting sounds associated with the video game being played. In certain embodiments, the lighted gaming desk 300 includes a plurality of speakers.

The lighted gaming desk 300 may also include a vibration mechanism (not shown) that is capable of emitting vibrations that are associated with the video game being played. An example of one such device that is capable of emitting vibrations is a subwoofer. The vibration emitting mechanism may be linked to the at least one speaker, a controller or the gaming system.

In use, the enhanced visibility lighting 310 of the lighted gaming desk 300 may be illuminated in a variety of colors and light patterns. Similar to the enhanced visibility lighting in the other embodiments described in this application, the configuration of the enhanced visibility lighting 310 not only causes the light emitted from a plurality of lighting sources to be diffused such that the light appears to be emitted from a single continuous light source but the invention also causes the light to be emitted over the width of the enhanced visibility lighting 310.

Such lighting results are superior to the prior art lighted gaming chairs and furniture, which thereby increases the immersive experience of the gaming not only for the person who is playing the video game but also for persons who are watching the person who is playing the video games.

The enhanced visibility lighting 310 may be operable in a variety of modes of operation. The user may utilize a variety of mechanisms to switch between the modes of operation. An example of one mechanism for controlling the operation of the enhanced visibility lighting 310 is an in-line switch that enables a person using the lighted gaming desk 300 to change at least one of a lighting pattern and a lighting color. Alternatively or additionally, the enhanced visibility lighting 310 may be controlled using an application on a mobile phone or using a webpage.

Using a manner that is similar to the manner described with respect to the preceding embodiments of the invention, the enhanced visibility lighting 310 are connected to a power source and a controller. The controller controls illumination of the enhanced visibility lighting 310. The controller may also include the ability for the person playing the video game to change colors and/or patterns at which the lights are illuminated. Such control may be directly changed on the object or may be remotely controlled on a wireless remote or using an application on a mobile phone.

In other embodiments, the controller may be linked to the video game unit and/or the computer on which the video game is being played. Using such a configuration enables the enhanced visibility lighting 130 to be illuminated to correspond with aspects of the video game. The link between the controller and the video game unit and/or the computer may be wired or wireless.

Figure 16:
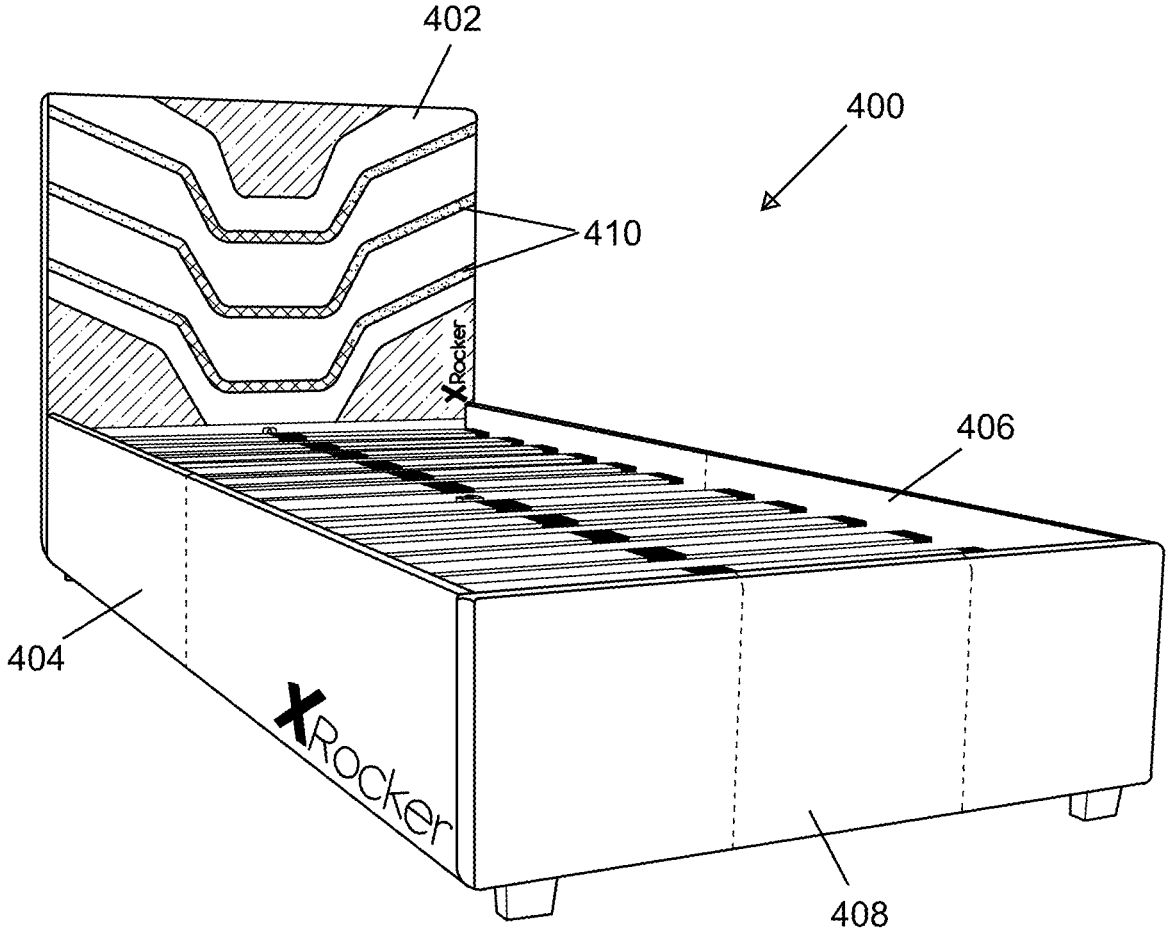
FIG. 16 is a perspective view of a lighted gaming bed frame with enhanced visibility lighting where an upper surface of the enhanced visibility has a flat configuration.

Another alternative furniture object is a lighted gaming bed frame 400, which is illustrated in FIG. 16. The lighted gaming bed frame 400 generally includes a headboard 402, a first side panel 404, a second side panel 406 and an end panel 408.

A person of skill in the art will appreciate that the components of the lighted gaming bed frame 400 may assume a variety of configurations using the concepts of the invention. In one such configuration, the headboard 402, the first side panel 404, the second side panel 406 and the end panel 408 each have a generally rectangular shape.

The lighted gaming bed frame 400 may be fabricated from and/or covered with a variety of materials having a variety of colors depending on the market in which the lighted gaming bed frame 400 is intended to be sold such as upper, moderate and value priced. Examples of materials that may be used to cover the surfaces of the lighted gaming bed frame 400 include leather, vinyl and fabric.

Figure 17:
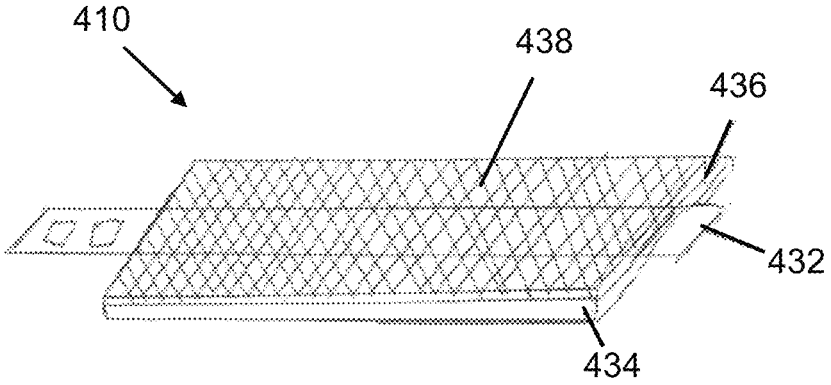
FIG. 17 is a perspective view of the flat enhanced visibility lighting for the lighted gaming bed frame of FIG. 16.
Figure 18:
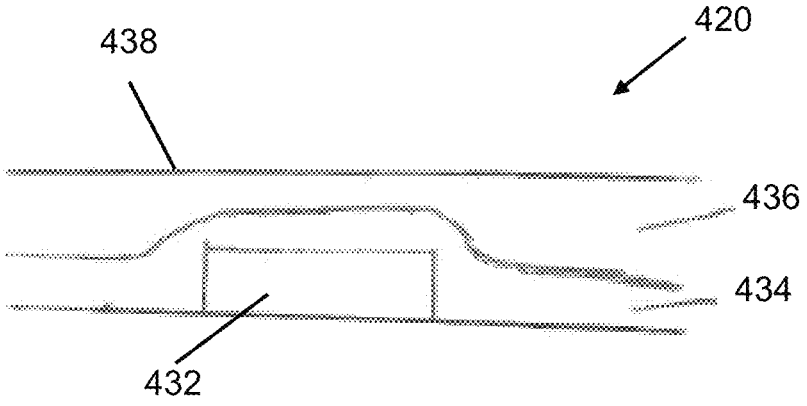
FIG. 18 is an end view of the flat enhanced visibility lighting for the lighted gaming bed frame of FIG. 16.

As illustrated in FIGS. 17 and 18, the enhanced visibility lighting 410 generally includes a light source 432. In certain embodiments, the light source 432 has an elongated configuration and includes a plurality of light emitting elements such as LEDs. A person of skill in the art will appreciate that the light source 432 may be fabricated from alternative materials using the concepts of the invention.

A diffusion layer 434 is placed over the light source 432. In certain embodiments, the diffusion layer 434 is an EPE foam layer. A person of skill in the art will appreciate that the diffusion layer 434 may be fabricated from alternative materials using the concepts of the invention.

The diffusion layer 434 causes the light emitted from the light source 432 to be more diffuse and spread out to thereby enhance the visibility of the lighting. The diffusion layer 434 also masks the individual bulbs in the light source 432 to make the illumination appear to be relatively continuous in contrast to the light emitted from the individual bulbs in the light source 432.

In certain embodiments, the diffusion layer 434 has an at least partially semicircular outer surface as illustrated in FIG. 20. The thickness of the diffusion layer 434 may be selected based upon a variety of factors such as the light transmissiveness of the material used to fabricate the diffusion layer 434 and the desired width of the enhanced visibility lighting 410.

The diffusion layer 434 has a width that is more than two times the width of light source 432. In other embodiments, the width of the diffusion layer 434 is more than about five times the width of the light source 432. In still other embodiments, the width of the diffusion layer 434 is between about five and about twenty times the width of the light source 432.

The semicircular profile of the diffusion layer 434 also enhances the ability to see light emitted from the light source 432 from more directions as compared to if the light was emitted from along the surface of the light gaming bed frame 400. This feature is particularly beneficial to persons who are not directly in front of the lighted gaming bed frame 400.

In situations where the upper surface of the diffusion layer 434 is not flat, as illustrated in FIG. 18, the enhanced visibility lighting 410 may include a cover layer 436 that is placed over the diffusion layer 434. The cover layer 436 may be fabricated from a generally transparent material. The upper surface of the cover layer 436 may be substantially flat across a width of the enhanced visibility lighting 410 as illustrated in FIG. 18.

A masking effect can be further increased by placing a masking layer 438 over the diffusion layer 434. In certain embodiments, the masking layer 438 may include a gridded mesh layer with a two-way reflective fabric (light-transmissive retroreflective fabric) in between similar to the embodiment illustrated in FIG. 3. The masking layer 438 may be selected to enhance the aesthetics of lighting while minimizing a decrease in the lumens transmitted therethrough. The masking layer 438 may also increase the durability of the lighted gaming bed frame 400 with enhanced visibility lighting 410 because the masking layer is more durable than the diffusion layer 434.

The invention thereby provides a seamless and attractive lighting finish that is brightly illuminated. The lights may be selected so that the lights are operable in a variety of colors. An example of one range of colors in which the lights may be illuminated includes red, orange, yellow, green, blue, indigo and violet. The lights may be operable in a single color at a time or may be operable in a gradient of colors.

The enhanced visibility lighting 410 may be mounted to the surface of the headboard 402. Alternatively, at least a portion of the enhanced visibility lighting 410 may be at least partially recessed in the surface of the headboard 402 similar to the manner in which the enhanced visibility lighting 310 is attached to the lighted gaming desk 302.

While FIG. 16 illustrates that the enhanced visibility lighting 410 is provided only on the headboard 402, it is possible for the enhanced visibility lighting 410 to be provided on at least one of the first side panel 404, the second side panel 406 and the end panel 408. When used in conjunction with these additional components, the enhanced visibility lighting 410 may be provided on at least one of an outer surface, an upper surface and an inner surface using the concepts described in this patent application.

Because of the greatly increased width of the light emitted from the enhanced visibility lighting 410 of this invention, the lighted gaming bed frame 400 provides an immersive experience for a person laying on the lighted gaming bed frame 400 while playing video games.

The lighted gaming bed frame 400 may include at least one speaker (not shown) that is capable of emitting sounds associated with the video game being played. In certain embodiments, the lighted gaming bed frame 400 includes a plurality of speakers.

The lighted gaming bed frame 400 may also include a vibration mechanism (not shown) that is capable of emitting vibrations that are associated with the video game being played. An example of one such device that is capable of emitting vibrations is a subwoofer. The vibration emitting mechanism may be linked to the at least one speaker, a controller or the gaming system.

In use, the enhanced visibility lighting 410 of the lighted gaming bed frame 400 may be illuminated in a variety of colors and light patterns. Similar to the enhanced visibility lighting in the other embodiments described in this application, the configuration of the enhanced visibility lighting 410 not only causes the light emitted from a plurality of lighting sources to be diffused such that the light appears to be emitted from a single continuous light source but the invention also causes the light to be emitted over the width of the enhanced visibility lighting 410.

Illumination of the enhanced visibility lighting 410 may be synchronized with the illumination of the enhanced visibility lighting in other components that are being used in conjunction with the lighted gaming bed frame 400. Alternatively, the illumination of the enhanced visibility lighting 410 may be controlled separately than the other illuminated components being used while playing video games.

The enhanced visibility lighting 410 may be operable in a variety of modes of operation. The user may utilize a variety of mechanisms to switch between the modes of operation. An example of one mechanism for controlling the operation of the enhanced visibility lighting 410 is an in-line switch that enables a person using the lighted gaming bed frame 400 to change at least one of a lighting pattern and a lighting color. Alternatively or additionally, the enhanced visibility lighting 410 may be controlled using an application on a mobile phone or using a webpage.

Using a manner that is similar to the manner described with respect to the preceding embodiments of the invention, the enhanced visibility lighting 410 are connected to a power source and a controller. The controller controls illumination of the enhanced visibility lighting 410. The controller may also include the ability for the person playing the video game to change colors and/or patterns at which the lights are illuminated. Such control may be directly changed on the object or may be remotely controlled on a wireless remote or using an application on a mobile phone.

In other embodiments, the controller may be linked to the video game unit and/or the computer on which the video game is being played. Using such a configuration enables the enhanced visibility lighting 410 to be illuminated to correspond with aspects of the video game. The link between the controller and the video game unit and/or the computer may be wired or wireless.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A lighted gaming chair comprising:

a chair comprising a seat portion and a back portion mounted with respect to the seat portion, wherein the back portion comprises a back portion edge, wherein the seat portion comprises a seat portion edge; and enhanced visibility lighting attached to the back portion and the seat portion to extend at least partially along the back portion edge and the seat portion edge, wherein the enhanced visibility lighting comprises:

a light source, a diffusion layer that substantially covers the light source, wherein the light source has a first width and wherein the diffusion layer has a second width that is more than two times the first width; and a masking layer that substantially covers the diffusion layer, wherein the masking layer comprises a two-way reflective fabric and wherein light emitted from the light source passes through the diffusion layer and the masking layer.

2. The lighted gaming chair of claim 1, wherein the light source comprises a plurality of spaced-apart light sources, wherein the enhanced visibility lighting makes light emitted from the spaced-apart light sources appear as the light is emitted from a single continuous light source and wherein the enhanced visibility lighting causes the emitted light to appear that the emitted light is emitted by the light source having the second width.

3. The lighted gaming chair of claim 1, wherein the light source has an elongated configuration.

4. The lighted gaming chair of claim 1, wherein the light source is capable of emitting light in a plurality of colors and a plurality of patterns.

5. The lighted gaming chair of claim 1, wherein the diffusion layer has a height that is more than two times the width of the light source and wherein the diffusion layer is at least partially fabricated from a foam material.

6. The lighted gaming chair of claim 1, wherein the masking layer further comprises:

at least one gridded mesh layer and wherein light emitted from the light source is visible through the masking layer.

7. The lighted gaming chair of claim 1, wherein the lighted gaming chair further comprises:

a speaker;

a vibration mechanism; and a controller for operably connecting the light source, the speaker and the vibration mechanism to a video gaming system.

8. The lighted gaming chair of claim 1, wherein the chair further comprises at least one leg that is attached to at least one of the seat portion and the back portion, wherein the enhanced visibility lighting is attached to the at least one leg.

9. The lighted gaming chair of claim 1, wherein the two-way reflective fabric is light-transmissive retroreflective fabric.

10. A method of illuminating a gaming chair, wherein the method comprises:

providing a gaming chair with enhanced visibility lighting attached thereto, wherein the gaming chair comprises a back portion and a seat portion, wherein the back portion comprises a back edge, wherein the seat portion comprises a seat edge, wherein the enhanced visibility lighting is attached to the back portion and the seat portion to extend at least partially along the back portion edge and the seat portion edge, wherein the enhanced visibility lighting comprises a light source, a diffusion layer and a masking layer, wherein the diffusion layer substantially covers the light source, wherein the light source has a first width and wherein the diffusion layer has a second width that is more than two times the first width, wherein the masking layer substantially covers the diffusion layer and wherein the masking layer comprises a two-way reflective fabric; and emitting light from the light source, wherein the enhanced visibility lighting causes the emitted light to appear as the emitted light is emitted from the light source having the second width.

11. The method of claim 10, wherein the light source comprises a plurality of light sources in a spaced-apart configuration, wherein the diffusion layer causes the emitted light from individual spaced-apart light sources appear as the emitted light from a single continuous light source.

12. The method of claim 10, wherein the light source has an elongated configuration, wherein the diffusion layer has a height that is more than two times the width of the light source, wherein the diffusion layer is at least partially fabricated from a foam material, wherein the masking layer further comprises at least one gridded mesh layer and wherein light emitted from the light source is visible through the masking layer.

13. The method of claim 10, and further comprising:

controlling the light emitting with a controller;

emitting sounds from a speaker that is associated with the lighted gaming chair; and emitting vibrations from a vibration mechanism that is associated with the lighted gaming chair.

14. The method of claim 10, wherein the light is emitted in a plurality of colors and a plurality of patterns.

15. Lighted gaming furniture comprising:

furniture that a person uses when playing a video game on a video gaming system, wherein the furniture comprises an edge; and enhanced visibility lighting attached to the furniture to extend at least partially along the furniture edge, wherein the enhanced visibility lighting comprises:

a light source;

a diffusion layer that substantially covers the light source, wherein the light source has a first width and wherein the diffusion layer has a second width that is more than two times the first width; and a masking layer that substantially covers the diffusion layer, wherein the masking layer comprises a two-way reflective fabric and wherein light emitted from the light source passes through the diffusion layer and the masking layer.

16. The lighted gaming furniture of claim 15, wherein the light source comprises a plurality of spaced-apart light sources, wherein the enhanced visibility lighting makes light emitted from spaced-apart light sources appear as the light source is a single continuous light source and wherein the enhanced visibility lighting causes the emitted light to appear that the emitted light is emitted from the light source having the second width.

17. The lighted gaming furniture of claim 15, wherein the furniture comprises at least one of pedestal mounted furniture, floor furniture, tables, desks, bed headboards, bed frames, sofa style seating, ottomans and office furniture.

18. The lighted gaming furniture of claim 15, wherein the light source has an elongated configuration, wherein the diffusion layer has a height that is more than two times the width of the light source and wherein the diffusion layer is at least partially fabricated from a foam material.

19. The lighted gaming furniture of claim 15, wherein the masking layer further comprises at least one gridded mesh layer and wherein light emitted from the light source is visible through the masking layer.

20. The lighted gaming furniture of claim 15, wherein the lighted gaming chair further comprises:

a speaker;

a vibration mechanism; and a controller for operably connecting the light source, the speaker and the vibration mechanism.

21. The lighted gaming furniture of claim 15, wherein the two-way reflective fabric is light-transmissive retroreflective fabric.

* * * * *